US007845636B2

(12) United States Patent
Isaak et al.

(10) Patent No.: US 7,845,636 B2
(45) Date of Patent: Dec. 7, 2010

(54) APPARATUS AND METHOD FOR SPATIALLY ORIENTING BLANKS

(75) Inventors: Nikolaus Isaak, Bonefeld (DE); Reiner Schönberger, Groβholbach (DE); Carsten Schrader, Thalhausen (DE)

(73) Assignee: Winkler + Duennebier AG, Neuwied (DE)

( * ) Notice: Subject to any disclaimer, the term of this patent is extended or adjusted under 35 U.S.C. 154(b) by 168 days.

(21) Appl. No.: 12/295,804

(22) PCT Filed: Apr. 4, 2007

(86) PCT No.: PCT/EP2007/053294

§ 371 (c)(1),
(2), (4) Date: Jan. 26, 2009

(87) PCT Pub. No.: WO2007/115996

PCT Pub. Date: Oct. 18, 2007

(65) Prior Publication Data

US 2009/0139838 A1 Jun. 4, 2009

(30) Foreign Application Priority Data

Apr. 4, 2006 (DE) ..... 10 2006 015 731

(51) Int. Cl.
*B65H 9/04* (2006.01)

(52) U.S. Cl. ..... 271/243; 198/415

(58) Field of Classification Search ..... 198/415, 198/459.1–459.2; 271/243, 242, 245
See application file for complete search history.

(56) References Cited

U.S. PATENT DOCUMENTS 4,043,665 A * 8/1977 Caldwell ..... 355/76
4,696,465 A * 9/1987 Willi ..... 271/237
5,374,053 A 12/1994 Doucet et al.
5,938,193 A 8/1999 Bluemle et al.

(Continued)

FOREIGN PATENT DOCUMENTS

DE 44 37 914 A1 7/1995

(Continued)

OTHER PUBLICATIONS

English Translation of the International Preliminary Report on Patentability and Written Opinion of the International Searching Authority, 8 pages.

(Continued)

*Primary Examiner*—Mark A Deuble
(74) *Attorney, Agent, or Firm*—Osha Liang LLP

(57) ABSTRACT

A device for spatially orienting blanks having a length in a transport direction has at least one stop roll body rotatable about a rotation axis and having at least one stop element, and a driver transport system for driving the blanks relative to the stop roll body. The driver transport system has at least one driver roller that pushes the blanks against the driver transport system, and at least one roll body roller that pushes the blanks against the stop roll body, wherein the roll body roller is prestressed in contact with the stop roll body. The driver transport system is a transport belt system having at least one endlessly revolving transport belt. The driver roller is mounted such that path spacing between the roll body roller and the driver roller are set to the length of the blanks.

7 Claims, 4 Drawing Sheets

Figure 1:
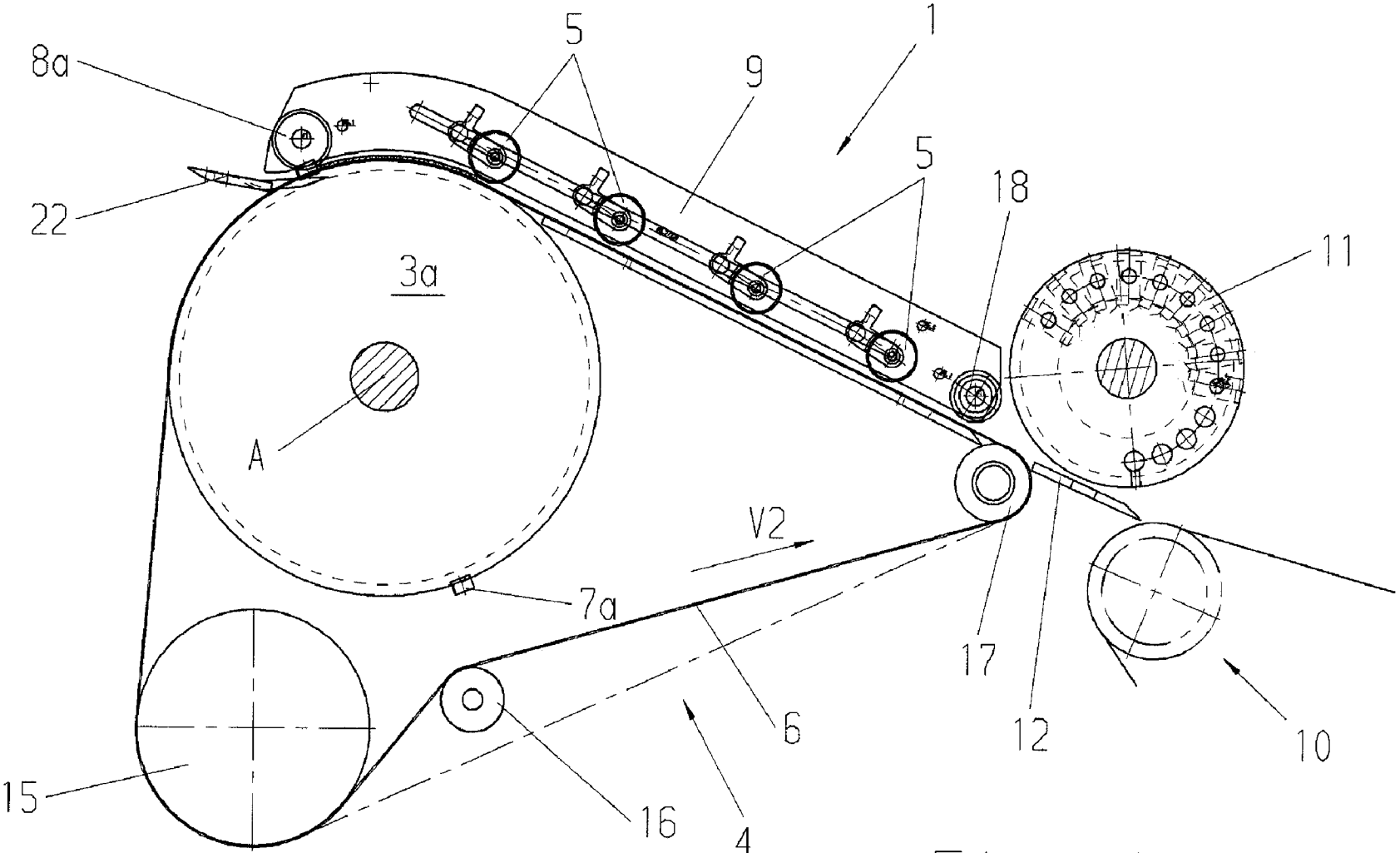

U.S. PATENT DOCUMENTS 7,681,882 B2 * 3/2010 Yu et al. ..... 271/243
2005/0258591 A1 11/2005 Blumle

FOREIGN PATENT DOCUMENTS

DE 196 09 991 A1 9/1997
DE 199 33 064 A1 1/2001
DE 10 2004 025427 A1 12/2005

OTHER PUBLICATIONS

International Search Report w/translation from PCT/EP2007/053294 datd Jun. 8, 2007 (4 pages).

* cited by examiner

APPARATUS AND METHOD FOR SPATIALLY ORIENTING BLANKS

I. FIELD OF APPLICATION

The present invention relates to an apparatus and a method for spatially orienting (adjusting) blanks, particularly envelope blanks and/or almost completely folded envelopes in an envelope production machine. The term envelope relates to all letter covers as well as mailing wallets of all sorts. Blanks in the sense of the present invention may also represent label blanks, for example bottle labels, or lid blanks for lids of food containers. For reasons of simplicity, prior art and the invention are illustrated in the following using the example of the production of envelopes.

II. TECHNICAL BACKGROUND

The spatial orientation of blanks and/or almost completely folded envelopes, called adjusting, is necessary in envelope production machines in order to precisely position the blanks for the purpose of the exact processing in a subsequent processing step. For example, if the following processing step comprises a folding process the adjusting must ensure that the fold occurs precisely along an already pre-pressed fold line.

A device for adjusting blanks is already known from DE 196 09 991 A1. It comprises a driver roller that can be impinged with a vacuum, arranged such that it can rotate coaxially between two stop roll bodies, which in turn are each provided with stop elements projecting in the radial direction. The driver roller rotates with a higher circumferential speed than the two synchronously rotating stop roll bodies. The blank to be oriented is caught by the vacuum effect of the driver roller and based on its higher circumferential speed it contacts the stop elements rotating at a slower speed. Here, the front edge of the blank is oriented from a potentially false position into one precisely perpendicular in reference to the transport direction.

The known device requires the impingement of the driver rollers with a vacuum, which is always connected to a certain expense. DE 196 09 991 A1 alternatively suggests to press the blanks to the driver roller via driver rollers. Such an embodiment leads in the device known that already oriented blanks are still pushed with the increased circumferential speed of the driver rollers, which can lead to malfunctions, such as a blank jam and consequently an interruption of production.

Another disadvantage of the device known from DE 196 09 991 A1 results from the tearing roll here being arranged relatively closely to the adjusting roll. This leads undesirably to the diameter of the adjusting roll having to be selected comparatively large in order to allow the orientation of large blanks and/or envelopes, which here must be located entirely on the perimeter of the adjusting roll. The next blank can only be separated from the scaled arrangement when the previous blank is located entirely on the perimeter of the adjusting roll.

From DE 10 2004 025 427 A1 a combined arrangement for accelerating and spatially orienting blanks is known.

In this arrangement as well, a driver roller body is used that can be impinged with a vacuum, which rotates with a higher circumferential speed than the two stop roll bodies allocated thereto. Alternatively it is suggested here to provide a transportation belt device instead of a driver roller body impinged with a vacuum, in which at least two transportation belts arranged over top of each other cooperate with each other such that they can entrain blanks by way of friction. Due to the sandwich-like clamping of the blank in this embodiment the already oriented blanks, contacting the stop elements with their front edges, have no liberty of movement to compensate the pushing motion of the two transport belts traveling at higher speeds. Such compensation requires slippage between the transport belts and the blanks, which on the one hand must meet the requirements of friction for the purpose of transportation and, on the other hand, may lead to undesired sliding tracks on the blanks.

III. DESCRIPTION OF THE INVENTION a) Technical Object

Therefore, the object of the present invention is to provide a device and a method for the spatially orientation of blanks and/or envelopes, which operate without a vacuum and simultaneously minimize the probability of a malfunction in the form of a blank jam and the probability of sliding tracks or the like on the blanks.

b) Solution of the Object

This object is attained in a device having the features of claim 1 and/or in a method having the features of claim 7.

Further embodiments of the present invention result from the sub-claims.

According to the invention, a device is suggested for the spatially orientation and/or adjustment of blanks and/or envelopes, in which the driver transport device is embodied as a transport belt device having at least one continuously circulating transport belt. However, several in the transport level parallel positioned transport belts are possible as well. The driver roller is supported according to the invention in an adjustable fashion such that the belt distance between the roller body roll and the driver roller can be adjusted to the length of the blanks to be oriented. The above-mentioned path distance refers to the distance between the roll body roller and the driver roller measured on the surface of the transport belt.

The stop roll body supporting the stop element rotates in a conventional manner at a first belt speed equivalent to the clock speed of the production machine. The transport belt travels with a second belt speed greater than the first belt speed.

According to the invention it is beneficially ensured that a blank can only be transported and/or pushed either by the transport belt or the cooperating driver roller or only be transported and/or pulled by the stop roll body and the cooperating roll body roller.

In the area of the path the blank travels through, located between the driver roller and the roll body roller, the blank can move in a direction perpendicular in reference to the transport level, i.e. particularly bulge in a corrugated fashion, when the blank has already contacted the stop element of the stop roll body and the transport belt continues to push the blank with the higher, second belt traveling speed. This buckling condition only lasts over a relatively short period of time, though, because the front edge of the blank is grasped immediately after contacting the stop element of the roll body roller cooperating with the stop roll body and then according to the invention immediately the rear edge of the blank leaves the gap between the driver roller and the transport belt and thus is released.

Therefore, within the scope of the present invention slippage between the transport belt and the blank is not absolutely necessary. The compensation of the briefly occurring buckling effect at the blank in the above-described sense can occur by way of a lateral deflection and/or bulging of individual sections of the blank perpendicular in reference to the transport direction. For the rest, a brief occurrence of the buckling effect is actually beneficial because it causes the blank to be pressed with sufficient force against the stop element. This effect results in a precise orientation of the blank.

The continuously circulating transport belt is guided via several rotationally supported deflection rolls. One of the deflection rolls is arranged coaxially in reference to the stop roll body and has a slightly smaller diameter than the stop roll body so that the surface of the transport belt in reference to the jacket surface of the stop roll body is positioned flush or slightly off-set inwardly. This way a linear section of the transport belt results, by which the blanks can be tangentially fed to the stop roller body. A circular arc-shaped section follows the linear section of the transport belt, with its curve being equivalent to the one resulting from the diameter of the stop roll body and/or the deflection roll. The circular arc-shaped section ends in the area of the site at which the roll body roller is located. The adjustment, i.e. the feeding of the front edge of the blank to the stop element of the stop roll body occurs in the above-mentioned circular arc-shaped section of the transport belt.

Beneficially a guiding device can be provided which guides the blanks along the linear section and/or along the circular arc-shaped section of the transport belt loosely and/or with some play such that sufficient wave-shaped bulging motions of individual sections of the blank remain possible. The distance between the surface of the transport belt and the guiding surface of the guiding device amounts to preferably at least twice the material thickness of the blanks, here.

Further, it is advantageous to support both the driver roller as well as the roll body roller freely rotational in the guiding device. Here, the roll body roller is mounted locally fixed to the guiding device and pre-stressed in the direction of the stop roll body. The driver roller can particularly beneficially be arranged in an adjustable fashion at the guiding device along the linear sections and/or along the circular arc-shaped section of the transport belt This way it is ensured that the belt distance between the locally fixed roll body roller and the driver roller can always be adjusted such that according to the invention it is essentially equivalent to the length of the blanks and/or envelopes to be oriented.

Preferably two or more driver rollers are mounted along the linear section and/or along the circular arc-shaped section of the transport belt at the guiding device, adjustable in reference to each other. The distances between the individual driver rollers as well as the distance between the foremost driver roller in the traveling direction and the roll body roller can then be adjusted such that they each are essentially equivalent to the length of the blank and/or the envelope. This way the transportation of even shorter blanks is ensured in the linear section of the transport belt. Depending on the length of the blanks one, two, or more driver rollers can be operational simultaneously.

c) Exemplary Embodiments

Figure 2:
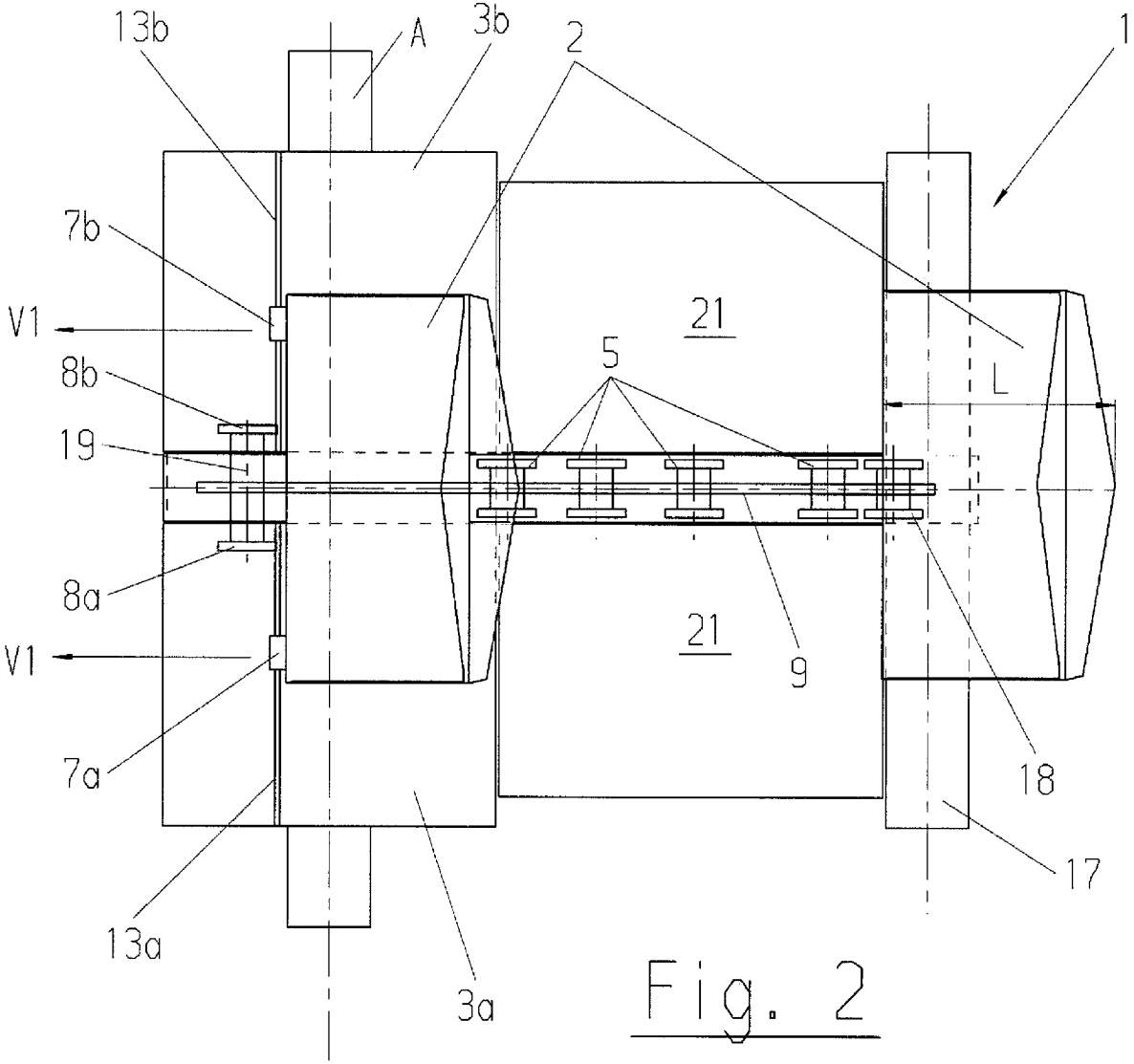
Figure 3:
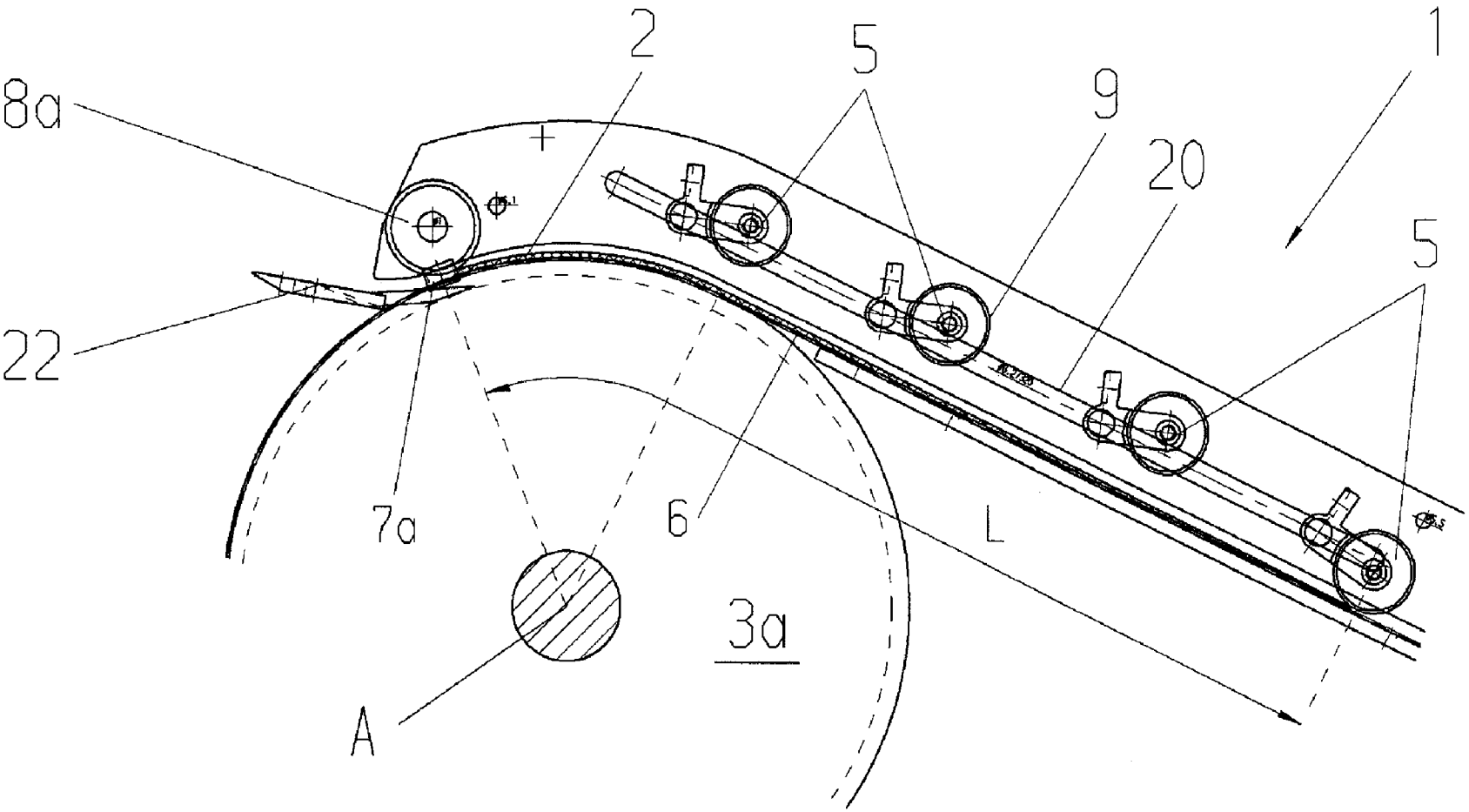
Figure 4:
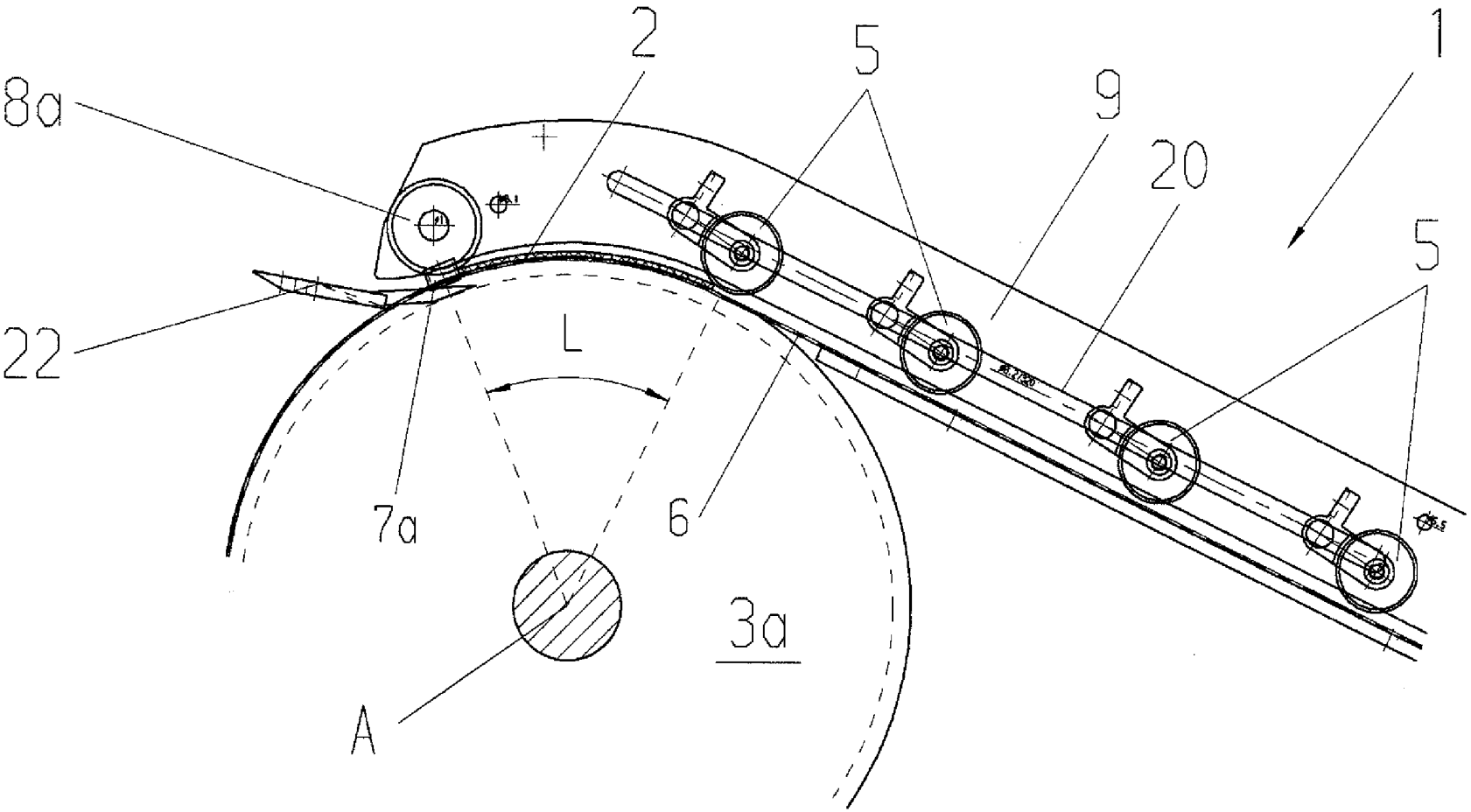

In the following, an exemplary embodiment of the device according to the invention and the method according to the invention are described in an exemplary fashion using the attached figures. It shows:

FIG. 1: a side view of an exemplary embodiment of a device according to the invention;

FIG. 2 a top view of the device according to the invention according to FIG. 1 with two almost completely folded envelopes;

FIG. 3 a detailed side view of the device according to the invention according to FIG. 1, with an envelope being shown having the maximally possible length; and FIG. 4 a side view of a detail of the device according to the invention according to FIG. 1, with an envelope being shown having the minimum size possible.

FIGS. 1 and 2 show a device 1 for the spatially orientation of almost completely folded blanks and/or envelopes 2. Only the folding of the closing flap remains to be done. The envelopes 2 to be oriented are fed to the device 1 with the help of the transport device 10, shown in FIG. 1 at the bottom right, in a scaled condition. With the help of an acceleration and/or spiked roll 11 that can be impinged with a vacuum and a guiding plate 12 the envelope blanks 2 are transferred individually and in a separated condition to the device 1. The transport belt arrangement 10, the spiked roll 11, and the guiding plate 12 are not components of the device 1 according to the invention and are not shown in FIG. 2.

The device 1 comprises two cylindrical stop roll bodies 3*a*, 3*b*, supported synchronously rotational around an axis A. The stop roll body

3*a*, 3*b* are each provided in their jacket surfaces with axially parallel grooves 13*a*, 13*b*, in which one radially projecting stop element 7*a* and/or 7*b* can be mounted. The axially distance of the stop elements 7*a* and 7*b* from each other can be suitably adjusted depending on the width of the envelopes 2 by displacing them in the grooves 13*a* and 13*b*. The stop roll bodies 3*a*, 3*b* rotate synchronously, with the stop elements 7*a*, 7*b* moving in the circumferential direction with a first belt speed v1 equivalent to the clock speed of the envelope production machine.

It is not shown in the figures that a deflection roll is arranged between the two stop roll bodies 3*a*, 3*b*, which has a slightly smaller diameter than the stop roll body 3*a*, 3*b*. The deflection roll is arranged coaxially in reference to the stop roller bodies 3*a*, 3*b* and serves to deflect a continuous transport belt 6, which is a component of the transport belt arrangement 4. With the help of the drive roll 15 the transport belt 6 is driven in a counter clock-wise direction with a second belt speed v2, which is greater than the belt speed v1 of the stop elements 7*a*, 7*b*. The transport belt 6 additionally travels around a belt pulley 16 as well as another deflection roll 17.

As discernible in FIGS. 1 and 2, a guiding device in the form of a vertically arranged guiding bar 9, for example embodied as a guiding sheet, is arranged above the section of the transport belt 6 serving for the transportation of the envelopes 2. The bottom edge of the guiding bar 9 is formed by a guiding surface arranged with a constant distance above the transport belt 6.

As discernible in FIG. 1 the guiding surface of the guiding bar 9 has a straight section as well as a circular arc-shaped section progressing in a curved fashion. The straight section of the guiding surface is located opposite the linear section of the transport belt 6 feeding the envelopes 2 tangentially to the stop roll bodies 3*a*, 3*b*. The circular arc-shaped section of the guiding surface is positioned opposite the following circular-arc shaped section of the transport belt 6. The distance between the guiding surface and the surface of the transport belt 6 preferably amounts to at least twice the thickness of the envelopes 2, i.e. in the present case twice the two-fold material thickness of the paper the envelopes are made from.

The guide rail 9 bears a contact roller 18, which is mounted stationarily and which is prestressed in the direction of the transport belt 6. Moreover, in the illustrated embodiment the guide rail 9 bears four driver rollers 5, which can be moved—in particular, swivelled—between a contact position and an inoperative position. FIG. 1 shows only the driver roller 5 (shown on the far right) in its active contact position, in which it is pressed so as to be prestressed by springs against the transport belt 6. The three other driver rollers 5 are located in their inoperative position, swivelled away from the transport belt 6. As shown in FIG. 2, each of the driver rollers 5 and the contact roller 18 are configured as a twin roller or rather a twin roll.

In addition, the guide rail 9 bears two roll body rollers 8*a* and 8*b*, which are mounted stationarily. The two roll body rollers 8*a* and 8*b* are connected together by means of a roller shaft 19, which is prestressed in the direction of the transport belt 6 and/or the axis A of the stop roll bodies 3*a*, 3*b* and the diverter roller 14.

The configuration, depicted in FIG. 1, is suited for orienting those envelope formats that exhibit the greatest length from right to left in the transport direction of FIGS. 1 and 2. In this context it depends on the length L of the envelope 2, which is still not finished folded in its entirety. This length, which is depicted in FIG. 2, takes into consideration the sealing flap. The configuration in FIG. 1 is depicted on an enlarged scale in the detailed view, according to FIG. 3.

In FIG. 2, the envelope 2, which has been detached by means of the detaching roller 11 and accelerated to a clock speed is then grasped by the contact roller 18, which is prestressed against the transport belt 6. Thereupon the envelope 2 is accelerated to the path speed v2, which is greater than the clock speed. Finally the driver roller 5, which is depicted on the far right in FIGS. 1 and 2, grasps the envelope 2, so that this envelope continues to be conveyed at the path speed v2.

In this way the leading edge of the envelope 2 finally arrives at the two stop roll bodies 3*a* and 3*b*, where said edge strikes against the two stop elements 7*a* and 7*b*, which move at the lower path speed v1. At this instant the transport belt 6 pushes the envelope 2 at the higher path speed v2 against the stop elements 7*a* and 7*b*, which are moving at the lower path speed v1. The loose guide of the envelope 2 by means of the guide rail 9 makes it possible for the envelope 2 to perform a compensating movement by bulging in certain areas.

Since the invention provides, however, that the path spacing between the roll body rollers 8*a*, 8*b* and the active driver roller 5 is always equivalent to the length L of the envelope 2 that is to be oriented, the bulging state lasts only as long as until the leading edge of the envelope 2 is grasped by the roll body rollers 8*a*, 8*b* and the stop roll bodies 3*a*, 3*b*. Owing to the inventive path spacing between the roll body rollers 8*a*, 8*b* and the active driver roller 5, the result is an automatic release of the trailing end of the envelope 2, as soon as its leading edge has been grasped by the roll body rollers 8*a*, 8*b*. Immediately following the release of the trailing end of the envelope 2, said envelope is no longer pushed forward at the higher path speed v2, so that the bulging state is cancelled and the envelope 2 can rest flush against the transport belt 6 and/or the shell of the stop roll bodies 3*a*, 3*b*.

FIGS. 1, 3 and 4 show a slot 20, which is provided in the guide rail 9 and along which the active driver roller 5 can be set in parallel to the transporting section of the transport belt 6. In this way the invention makes it possible to adjust the path spacing between the roll body rollers 8*a*, 8*b* and the active driver roller 5, so that the device 1 can also be employed, according to the invention, after a change in format has been carried out.

FIG. 4 is an enlarged detailed view of that configuration, by means of which an envelope 2 having a very short length L can be controlled. To this end all four driver rollers 5 are in their active contact position, as shown in FIG. 4. In this case the invention provides that the path spacing between the roll body rollers 8*a*, 8*b* and the driver roller 5, which is shown on the far left in FIG. 4, amounts again to the relatively short length L of the envelope 2 that is to be oriented. In FIG. 4, the three other driver rollers 5, which are active on their own, have nothing to do with the actual controlling and/or orienting function, but rather serve only to make possible the transport of the envelopes 2 from the detaching roller 11 to the driver roller 5, which is shown on the far left in FIG. 4 and is active, according to the invention.

As evident from FIG. 2, supporting plates 21 are disposed on both sides next to the transport belt 6 and between the diverter roller 17 and the stop roll bodies 3*a*, 3*b*, in order to prevent the envelopes 2 from hanging down laterally next to the transport belt 6. As FIGS. 1, 3 and 4 clearly show, there is, moreover, a separating guide 22 in order to be able to feed the oriented envelopes 2 to the next processing station—in this case, the downstream sealing flap folding station.

LIST OF REFERENCE NUMERALS

1 device
2 envelope
3*a, b* stop roll body
4 transport belt system
5 driver roller
6 transport belt
7*a, b* stop element
8*a, b* roll body roller
9 guide rail
10 transport web system
11 accelerating and/or detaching roller
12 guide plate
13*a, b* groove
15 drive roller
16 tensioning roller
17 additional diverter roller
18 contact roller
19 roller shaft
20 slot
21 supporting plate
22 separating guide
A axis
L length of the envelope 2
v1 first path speed
v2 second path speed

The invention claimed is:

1. A device for spatially orienting blanks having a length in a transport direction comprising:

at least one stop roll body rotatable about a rotation axis and having at least one stop element; and a driver transport system for driving the blanks relative to the stop roll body, comprising:

at least one driver roller that pushes the blanks against the driver transport system, and at least one roll body roller that pushes the blanks against the stop roll body, wherein the roll body roller is prestressed in contact with the stop roll body, wherein the driver transport system is a transport belt system comprising at least one endlessly revolving transport belt; and wherein the driver roller is mounted such that path spacing between the roll body roller and the driver roller are set to the length of the blanks.

2. The device as claimed in claim 1, wherein the transport belt system comprises a diverter roller, rotatable about the rotation axis and operable to divert the transport belt, and having a diameter substantially equal to the stop roll body, defining a linear section of the transport belt in which the blanks are fed tangentially to the stop roll body.

3. The device as claimed in claim 2, a guide system, which loosely guides the blanks along the linear section and along an adjoining circularly shaped section of the transport belt.

4. The device as claimed in claim 3, wherein the driver roller and the roll body roller are mounted in a freely rotatable manner on the guide system.

5. The device as claimed in claim 4, wherein the driver roller is mounted adjustably on the guide system along at least one of a linear section and a circular section of the transport belt.

6. The device as claimed in claim 4, wherein two or more driver rollers mounted so as to be adjustable in relation to each other on the guide system along at least one of the linear section and the circular section of the transport belt.

7. A method for spatially orienting blanks using a device comprising:

at least one stop roll body rotatable about a rotation axis and having at least one stop element; and a transport belt system for driving the blanks relative to the stop roll body, comprising:

at least one driver roller that pushes the blanks against at least one transport belt of the transport belt system, and at least one roll body roller that pushes the blanks against the stop roll body, said method comprising steps of:

rotating the stop roll body so that the stop element moves at a first path speed, feeding a blank to the stop roll body in a tangential direction of the stop roll body at a second path speed greater than the first path speed, so that the blank is held frictionally engaged between the transport belt and the driver roller, guiding a leading edge of the blank in a transport direction to the stop element in a path area, between the driver roller and the roll body roller such that the leading edge strikes against the stop element, grasping so as to be frictionally engaged the leading edge of the blank between the roll body roller and the stop roll body, and releasing a trailing edge of the blank in the transport direction when the leading edge has been grasped by the roll body roller.

* * * * *